US006059901A

United States Patent [19]

Sahu

[11] Patent Number: 6,059,901

[45] Date of Patent: May 9, 2000

[54] BISMUTHIZED CU-NI-MN-ZN ALLOY

[75] Inventor: Sudhari Sahu, Glendale, Wis.

[73] Assignee: Waukesha Foundry, Inc., Waukesha, Wis.

[21] Appl. No.: 09/157,666

[22] Filed: Sep. 21, 1998

[51] Int. Cl.[7] ..... C22C 9/04

[52] U.S. Cl. ..... 148/442; 148/433; 148/434; 148/435; 420/587; 420/479; 420/480; 420/493; 420/499

[58] Field of Search ..... 420/587, 471–473, 420/479, 480, 486, 489, 493, 499; 148/432–435, 442

[56] References Cited

U.S. PATENT DOCUMENTS

| | | | |
|---|---|---|---|
| 2,743,176 | 4/1956 | Thomas et al. . | |
| 4,702,887 | 10/1987 | Larson | 420/442 |
| 5,242,657 | 9/1993 | Sahu | 420/481 |
| 5,938,864 | 8/1999 | Tommikawa et al. | 148/435 |
| 5,942,056 | 8/1999 | Singh | 148/434 |

OTHER PUBLICATIONS

English language abstract of Japnese Patent Document JP409316570A, Dec. 1997.

*Primary Examiner*—John Sheehan
*Attorney, Agent, or Firm*—McEachran, Jambor, Keating, Bock & Kurtz

[57] ABSTRACT

Bismuth bearing copper-nickel-manganese-zinc corrosion and gall resistant castable alloy, particularly for use in food processing machinery, with the following weight percentage range:

Nickel=12–28
Manganese=12–28
Zinc=12–28
Aluminum=0.5–2.00
Bismuth=2–6
Phosphorus=0–0.3
Tin =0–1.5
Iron=0–1.0
Copper=Balance, substantially

10 Claims, 3 Drawing Sheets

BISMUTHIZED CU-NI-MN-ZN ALLOY

BACKGROUND OF THE INVENTION

This invention relates to a bismuth containing, corrosion resistant copper-nickel-manganese-zinc alloy suited for use in food handling machinery. This anti-galling alloy may be statically or continuously cast into different shapes and forms.

Traditionally "Dairy Metals" have been used in many food processing parts. Dairy metals are copper-nickel alloys containing varying amounts of tin, zinc, and lead. Lead has been an essential ingredient for these alloys because their anti-galling properties depend on it. Lead also improves machinability of these alloys. Typically, lead content of Dairy Metals lies between 2 and 7 percent by weight.

Toxicity of lead is now well established. Ingestion of even a few parts per million of lead into the human body causes significant concern with the medical community. As a consequence, special efforts have been made to eliminate lead from materials which might end up in human body. Lead has been generally replaced by bismuth in many anti-galling and low friction alloys. The same is true for alloys requiring good machinability. Examples of bismuth-bearing nickel-base anti-galling alloys are those of Thomas and Williams (U.S. Pat. No. 2,743,176) and of Larson (U.S. Pat. No. 4,702,887). These alloys have been in use for decades. However these alloys are very expensive and are restricted to only special applications.

More recently, bismuth has been used to replace lead in dairy metals (Sahu; U.S. Pat. No. 5,242,657). This alloy has good corrosion and anti-galling characteristics but suffers from low strength and very poor ductility. As a result, very thin parts like scraper blades made out of this alloy fracture during use or shatters if mishandled during finishing process. Because of low strength of alloy of U.S. Pat. No. 5,242,657; food forming plates can not be made thinner than about 0.3 inches because they fracture during use. Low ductility of this alloy sometimes leads to fracture during straightening of machined parts.

Therefore, the objectives of this invention are the following:

1. A moderate cost alloy
2. Alloy with good corrosion and anti-galling properties
3. Alloy with strength and ductility substantially higher than those of U.S. Pat. No. 5,242,657

SUMMARY OF THE INVENTION

The preferred analysis of this alloy is as follows:

| Element | Weight Percent |
|---|---|
| Nickel | 20 |
| Manganese | 20 |
| Zinc | 20 |
| Aluminum | 1 |
| Bismuth | 3.5 |
| Phosphorus | 0.2 |
| Copper | Balance |

Variation in the above chemistry is possible and a satisfactory alloy can have the following chemical ranges:

| Element | Weight Percent |
|---|---|
| Nickel | 12–28 |
| Manganese | 12–28 |
| Zinc | 12–28 |
| Aluminum | 0.5–2.0 |
| Bismuth | 2–6 |
| Phosphorus | 0–0.30 |
| Tin | 0–1.5 |
| Iron | 0–1.0 |
| Copper | Balance |

This alloy may contain small amounts of C, Si, Sn, Ti, Fe and other elements as incidental or trace amounts. When the ingredients are mixed in approximately the preferred analysis, the following physical properties are obtained:

Tensile Strength=42–58 KSI

Yield Strength=34–45 KSI

Percent Elongation=3–8

Hardness=110–175 BLN

BRIEF DESCRIPTIONS OF THE ILLUSTRATIONS

DESCRIPTION OF THE PREFERRED EMBODIMENTS

The alloy of the present invention can be melted in a gas fired crucible or in an induction furnace. Nickel is charged at the bottom of the melting vessel followed by copper. Melting is started at high power. When the charge is partially molten manganese is gradually added which melts readily. When the charge is completely molten aluminum is added first followed by zinc. Aluminum prevents loss of zinc during melting. Bismuth is added next. After a few minutes, preliminary analysis is made of the melt. Adjustment in chemistry is made at this point. The melt is then deoxidized with phos-copper and other proprietary deoxidizing agent. The heat is then tapped into a pouring ladle and poured into molds to cast parts of desired shape and size. Following are chemical and mechanical properties of four heats made this way.

TABLE 1

Chemistry of Bismuthized Cu—Ni—Mn—Zn Alloy (Weight Percent)

| Heat No. | Cu | Ni | Mn | Zn | A1 | P | Bi |
|---|---|---|---|---|---|---|---|
| K816 | Bal | 17.66 | 18.06 | 20.93 | 0.80 | 0.12 | 3.49 |
| K898 | " | 17.22 | 19.55 | 16.64 | 1.35 | 0.14 | 2.33 |
| A470 | " | 17.11 | 18.07 | 21.20 | 1.12 | 0.18 | 4.60 |
| A579 | " | 18.13 | 18.91 | 20.45 | 0.94 | 0.14 | 3.40 |

Mechanical properties of above alloys are given in Table 2.

TABLE 2

Mechanical Properties of Cu—Ni—Mn—Zn Alloy

| Heat No | Tensile Strength | Yield Strength | Percent Elongation | Hardness |
|---|---|---|---|---|
| K816 | 51.1 KSI | 34.7 KSI | 4.0 | 149 BHN |
| K898 | 54.9 KSI | 41.5 KSI | 6.0 | 149 BHN |
| A470 | 50.7 KSI | 38.7 KSI | 4.0 | 149 BHN |
| A579 | 54.3 KSI | 37.9 KSI | 7.0 | 156 BHN |

The alloy of U.S. Pat. No. 5,242,657 (Column 2, lines 59 to 65) has a tensile strength of less than 22 KSI and elongation of 2.5 percent maximum. Thus it is clear that the present alloy has over twice the tensile strength of that of U.S. Pat. No. 5,242,657. The same applies to the value of percent elongation. Combination of high strength and high elongation makes the present alloy suitable for application like scraper blades.

FRICTION PROPERTIES

Anti-galling alloys must necessarily have a low coefficient of friction in rubbing contact in marginally lubricated condition. To evaluate this, testing was done according to modified ASTM D3702 method. Rings of present alloy were run against 316 stainless steel washers at room temperature in distilled water. Coefficients of friction (C.O.F.) were measured for given PV values and are plotted in FIG. 1. Pressure P was measured in pounds per square inch (PSI) and the velocity V was measured in feet per minute. Higher PV value means higher intensity of loading. For comparison purposes, the alloy of U.S. Pat. No. 5,242,657 has been included as a broken line.

Figure 1:
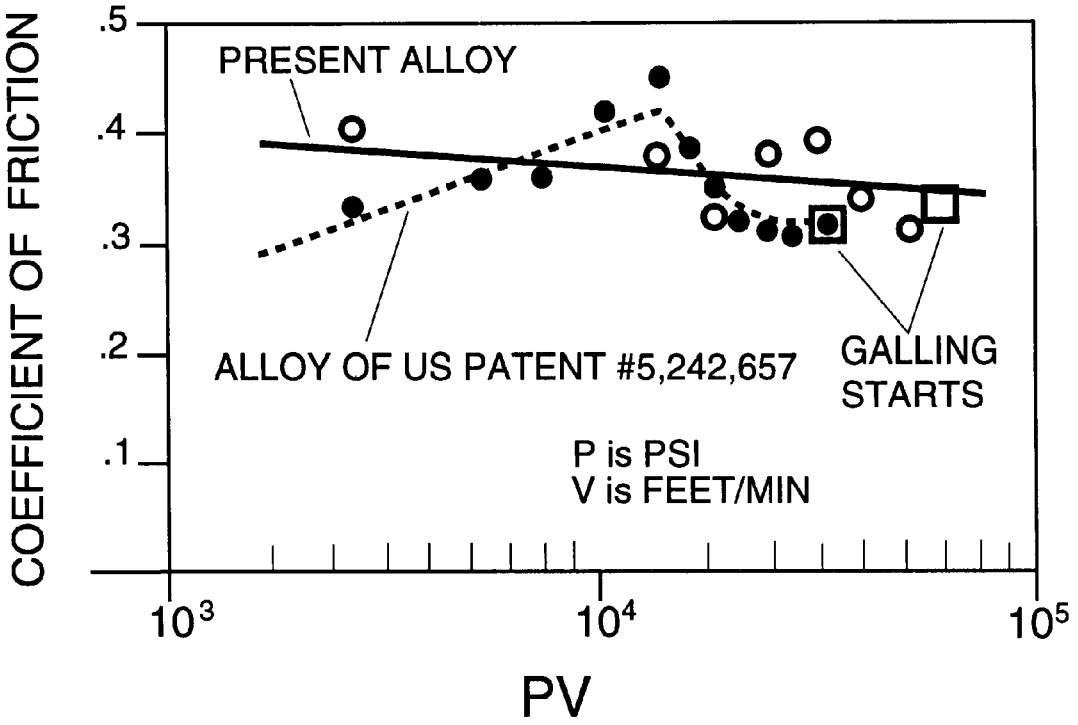
FIG. 1 is a graph showing the variation of coefficient of friction with the severity of loading represented by the product function PV.

It can be seen from FIG. 1 that the present alloy has C.O.F. similar to that of U.S. Pat. No. 5,242,657. Average C.O.F. between PV=2500 and 20,000 for the present alloy is 0.365 compared to a value of 0.355 for the alloy of U.S. Pat. No. 5,242,657. The PV value required for the start of galling for the present alloy is 42,500 compared to only 27,500 for the current alloy.

CORROSION RESISTANCE

The corrosion resistance of the alloy in contact with food and equipment cleaning solutions is very important. The alloy must have adequate corrosion resistance otherwise there will be product contamination due to corrosion product on one hand; on the other there will be difficulties in sanitizing and possible bacterial growth. Two common chemicals and two commercial cleaning and/or sanitizing compounds in recommended concentrations were selected to run the corrosion test. The list is given below.

1. Acetic acid solution in water (0.3 Normal).
2. Five weight percent of sodium hydroxide (NaOH) in water
3. Stera-Sheen: This is a cleaning and sanitizing formula sold by Purdy Products Company of Waukonda, Ill. Solution was prepared by dissolving 1.6 percent of this powder in water which resulted in 208 PPM active chlorine ion in solution.
4. Cloverleaf CLF-3300: This is a concentrated cleaning solution marketed by Cloverleaf Chemical Company of Bourbonals, Ill. The solution was prepared by mixing 10 ml of this concentrate with 990 ml distilled water. This solution had 275 PPM active chlorine ion in it.

The corrosion test was run according to ASTM specification G31-72. The specimen was in the form of a disc with nominal OD=1.25", ID=0.375" and thickness=0.187". The specimen was properly prepared and its dimensions and weight measured. The specimen was put inside a one liter solution of one of the above compounds. The solution was kept at 70 degrees celsius and mildly agitated with magnetic stirrer. The specimen was kept in the solution for 72 hours. At the end of this period, the specimen was taken out, washed thoroughly, dried and re-weighed. From the weight loss and dimensions of the specimen the corrosion rate in mils per year was calculated. Duplicate specimens were run for each condition and the reported corrosion rate is the average of two readings. For comparison purposes alloy of U.S. Pat. No. 5,242,657 was also tested under identical conditions. The results are given in Table 3.

TABLE 3

Corrosion Rate in Mils Per Year

| Alloy | Acetic Acid | NaOH | Stera-Sheen | CLF-3300 |
|---|---|---|---|---|
| Present Alloy | 23.04 | 1.35 | 8.70 | 0.00 |
| Alloy of U.S. Patent 5,242,657 | 21.00 | 2.13 | 19.08 | 0.15 |

An examination of this table makes it very clear that the present alloy has a little better corrosion resistance than the alloy of U.S. Pat. No. 5,242,657

Figure 2:
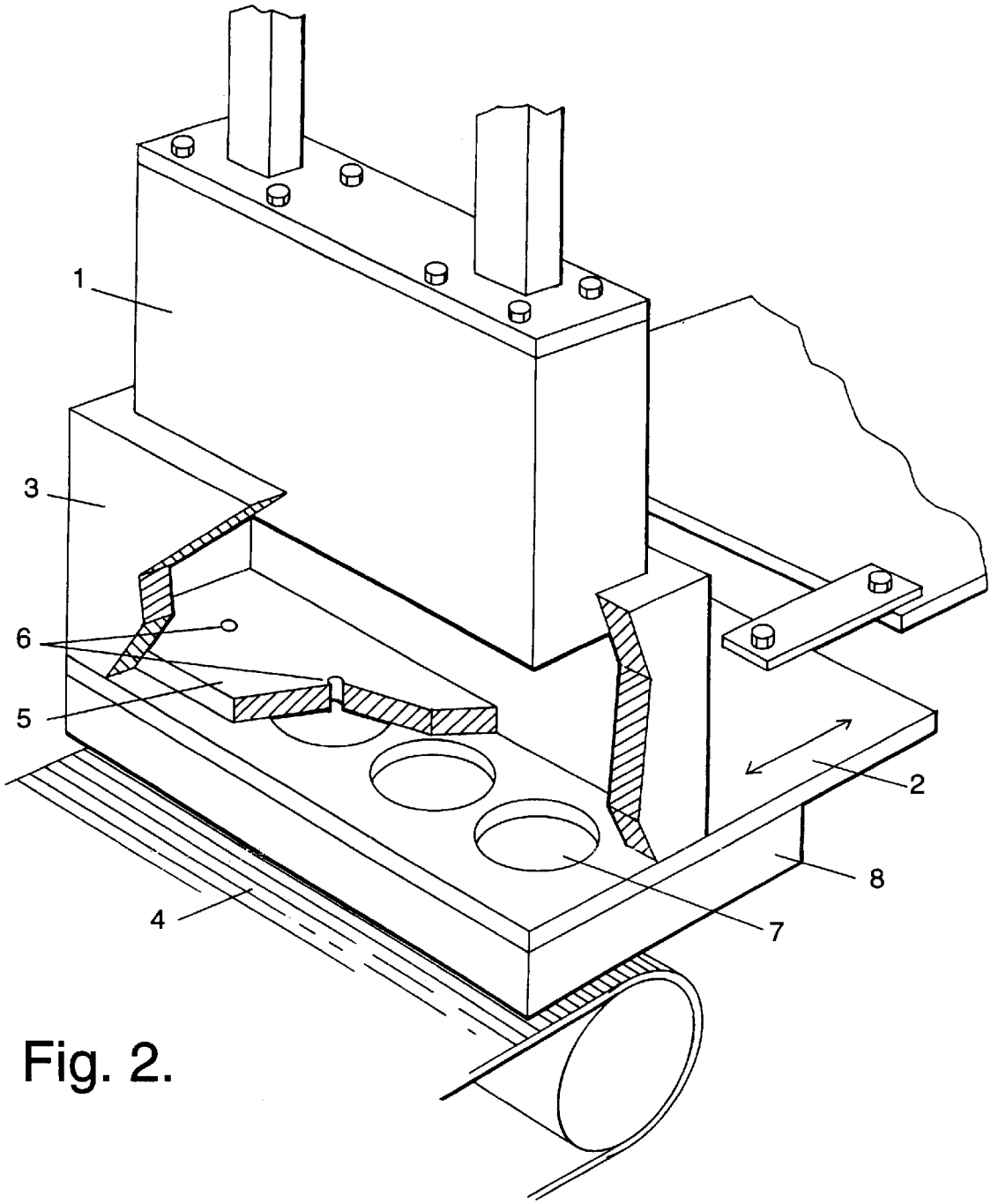
FIGS. 2 and 3 show examples of equipment in which parts made with the alloy of this invention are embodied.
Figure 3:
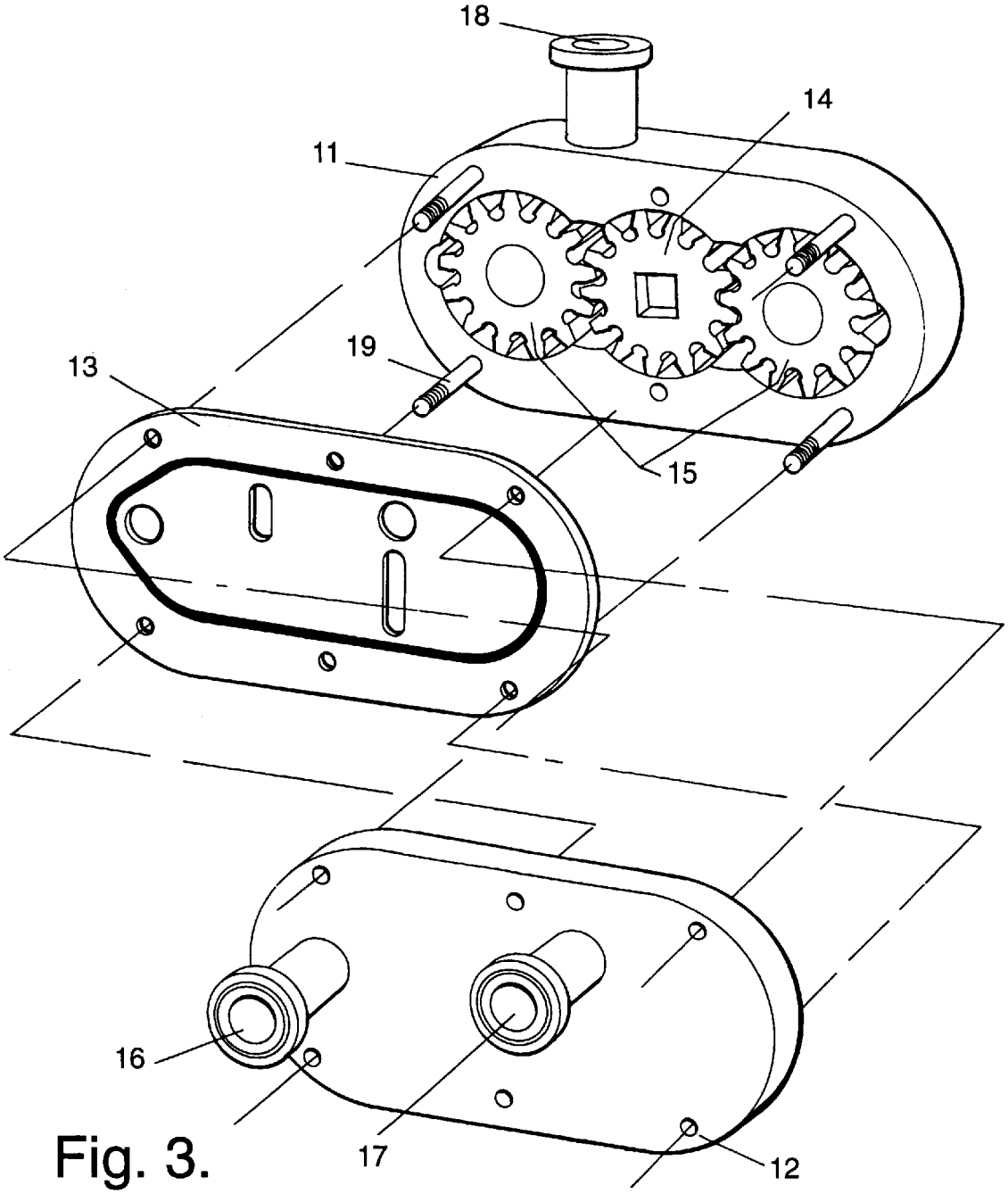

Two examples of typical equipment in which the present alloy may be embodied are shown in FIGS. 2 and 3. FIG. 2 depicts part of a food forming machine. Valve chamber 3, base plate 5 and plate support 8 may be standard cast or wrought stainless steel. Plunger and plate 2 (in contact with food) may be made from the present alloy. The opposed members 8 and 5 can also be made of the present alloy, as well as other parts in contact with food. In operation, the food product charged into the valve chamber 3 is pushed under pressure by plunger 1 into die cavities 7 through inlet openings 6 in the base plate 5.

The plunger then retracts. The plate 2 is pushed forward (to the left in FIG. 2) and portions are knocked out onto the conveyer 4. The plate then moves back into the original position and the whole process repeats again.

FIG. 3 depicts a product/air mix pump for an ice cream machine. Pump body 11, pump cover 12, gasket 13 and studs 19 may be machined out of stainless steel either cast or wrought. Drive gear 14 and pump gears 15 may be made out of present alloy. Other parts in contact with food products can be made of the present alloy. In application, mix and air are metered into inlets 16 and 17 respectively and the ice cream comes out of outlet 18 in a smooth, fine textured form.

I claim:

1. A bismuth bearing copper-nickel-manganese-zinc corrosion resistant and low friction alloy, consisting essentially of in weight percentage:

Ni=20
Mn=20
Zn=20
Al=1
Bi=4
P=0.2 and the balance substantially Cu.

2. A cast lead-free copper-nickel-manganese-zinc dairy bronze alloy consisting essentially in weight percentage:

Ni=12–28

Mn=12–28

Zn=12–28

Al=0.5–2.00

Bi=2–6

P=0–0.3

Sn=0–1.5

Fe=0–1.0 and the balance substantially Cu.

3. In a food processing machine in which opposed members are in contact with one another, at least one of the said members being fabricated of an alloy according to claim 1.

4. In a food processing machine according to claim 3 in which one of the opposed members is fabricated of said alloy and the other is made of stainless steel.

5. In a food processing machine in which opposed members are in contact with one other, at least one of the said members being fabricated of an alloy according to claim 2.

6. In a food processing machine according to claim 5 in which opposed members are in contact with one other, one of the said members being fabricated of said alloy and the other member being made of stainless steel.

7. In a food forming machine in which the opposed members in contact with each other are a plunger and a valve chamber and the plunger is fabricated of an alloy according to claim 1.

8. In an ice cream pump in which opposed members in contact with each other are a drive gear and a pump gear and each gear is fabricated of an alloy according to claim 1.

9. In a food forming machine in which opposed members are a plunger and a valve chamber and the plunger is fabricated of an alloy according to claim 2.

10. In an ice cream pump in which opposed members in contact with each other are a drive gear and a pump gear and each gear is fabricated of an alloy according to claim 2.

* * * * *